US007067755B1

(12) United States Patent
Schoal, Jr. et al.

(10) Patent No.: US 7,067,755 B1
(45) Date of Patent: Jun. 27, 2006

(54) SAVE A SWITCH

(76) Inventors: Edward Schoal, Jr., 329 Summit Ave., Westville, NJ (US) 08093; William Cosgrove, 232 Sylvan Ave., Gloucester City, NJ (US) 08030

( * ) Notice: Subject to any disclaimer, the term of this patent is extended or adjusted under 35 U.S.C. 154(b) by 0 days.

(21) Appl. No.: 11/135,248

(22) Filed: May 23, 2005

(51) Int. Cl.
*H01H 3/20* (2006.01)

(52) U.S. Cl. ..... 200/331; 200/329

(58) Field of Classification Search ..... 200/329–331, 200/537, 543; 24/602, 115 F, 115 R, 116 R
See application file for complete search history.

(56) References Cited

U.S. PATENT DOCUMENTS 1,721,222 A * 7/1929 Kaminsky ..... 200/331
1,747,758 A * 2/1930 Despard ..... 200/329
4,899,050 A * 2/1990 Cianflone ..... 200/331
5,017,746 A * 5/1991 Guimarin ..... 200/331
5,590,759 A * 1/1997 Hawkins et al. ..... 200/331
5,878,871 A 3/1999 Miesner

* cited by examiner

*Primary Examiner*—Michael Friedhofer
*Assistant Examiner*—Lisa Klaus
(74) *Attorney, Agent, or Firm*—Norman E. Lehrer

(57) ABSTRACT

A light switch device that aids a person to reach a pull chain attached to a light switch located above a bed having a movable side rail includes an elongated strap having a first member and a second member is disclosed. The first and second members are releasably secured to each other via hook and loop fasteners. The strap is secured to the pull chain via a tubular member with an opening formed therein. A portion of the pull chain is inserted through the opening and is secured thereto. The first and second members of the strap are releasably attachable to the movable side rail of the bed by separating the members, inserting the rail therebetween, and securing the members together. When the rail is lowered inadvertently the first and second members of the strap are pulled apart and are no longer secured together.

4 Claims, 2 Drawing Sheets

SAVE A SWITCH

BACKGROUND OF THE INVENTION

The present invention is directed toward a device used with a light switch and more particularly, toward a breakaway device that holds a light pull chain or cord connected to the light switch in place on the side rail of a bed so that a person lying in the bed may easily reach the switch but does not break the chain when it is inadvertently yanked or pulled hard, such as when the rail is lowered.

Typically, a light switch is located behind and above a patient or resident lying in a hospital or nursing home bed. A pull chain or cord is usually used to switch the light on or off. In order to assist the person in the bed to be able to reach the chain, a nurse or aide will tape or otherwise secure the chain to the bed side rail. This arrangement may help the person to reach the chain when the rail is in the upright position. However, when the rail is lowered, the chain may inadvertently remain attached to the rail, thereby breaking the chain. This results in time and expense that must be expended in order to replace the chain.

U.S. Pat. No. 5,878,871 to Miesner discloses a strap with a breakaway connector attached to the pull chain of a light switch. The strap extends the chain and may be used to secure the chain to a stationary object. The strap includes a connector that is intended to protect the switch from breaking when the chain is yanked or jerked. However, this connector appears to require a rather intrusive means for attaching to the chain. That is, it appears that the chain must be altered in some manner in order for the connector to attach thereto.

Therefore, a need exists for a reusable device that extends the length of a pull chain attached to a light switch without having to alter the existing chain, secures the chain to a bed side rail, and also prevents the chain from breaking when the chain is inadvertently yanked or pulled hard.

SUMMARY OF THE INVENTION

The present invention is designed to overcome the deficiencies of the prior art discussed above. It is an object of the present invention to provide a device for assisting a person lying in a bed to reach a pull chain or cord attached to a light switch.

It is another object of the present invention to provide a device that secures the pull chain or cord of a light switch to a bed side rail.

It is a further object of the present invention to provide a device that prevents the pull chain or cord attached to a light switch from being broken when it is inadvertently pulled or yanked while it is still attached to the bed side rail.

In accordance with the illustrative embodiments demonstrating features and advantages of the present invention, there is provided a device for assisting a person lying in a bed to reach a pull chain or cord attached to a light switch located above the bed having at least one movable side rail including an elongated strap having a first or left member and a second or right member, means for releasably securing the right and left members directly to each other, and means for securing the strap to the pull chain. The right and left members of the strap are releasably secured to each and are releasably attachable to the movable side rail by separating the members, inserting the rail in between the members and then securing the members again. The releasable securing means includes hook and loop fasteners mounted to the left and right members of the strap. The securing means includes a tubular member with an opening formed therein, a portion of the pull chain is insertable through the opening and is secured within the tubular member. When the strap is secured to the bed rail and the rail is inadvertently lowered, the right and left members will separate, thereby allowing the rail to be released without breaking the chain or otherwise damaging the switch.

There is also provided a method for aiding a person to reach a pull chain attached to a light switch located above a bed having movable side rails comprising the steps of providing an elongated strap including a right member and a left member, means for releasably securing the right and left members directly to each other, and means for securing the strap to the pull chain, wherein the right and left members of the strap are releasably secured to each other and releasably attachable to the movable side rail, securing the pull chain to the strap, securing the right and left members of the strap to the side rail, and pulling the chain in order to activate or deactivate the light. The releasable securing means includes hook and loop fasteners mounted to the left and right members of the strap. In order to use the device, the right and left members are separated, the rail is then inserted therebetween, and the right and left members are secured together. When the rail is lowered the right and left members of the strap are pulled apart as the rail passes between them so that the right and left members are no longer secured together. In this manner the pull chain is released from the rail without breaking or otherwise damaging the light switch or pull chain.

Other objects, features, and advantages of the invention will be readily apparent from the following detailed description of a preferred embodiment thereof taken in conjunction with the drawings.

BRIEF DESCRIPTION OF THE DRAWINGS

For the purpose of illustrating the invention, there is shown in the accompanying drawings one form that is presently preferred; it being understood that that invention is not intended to be limited to the precise arrangements and instrumentalities shown.

DETAILED DESCRIPTION OF THE PREFERRED EMBODIMENT

Figure 2:
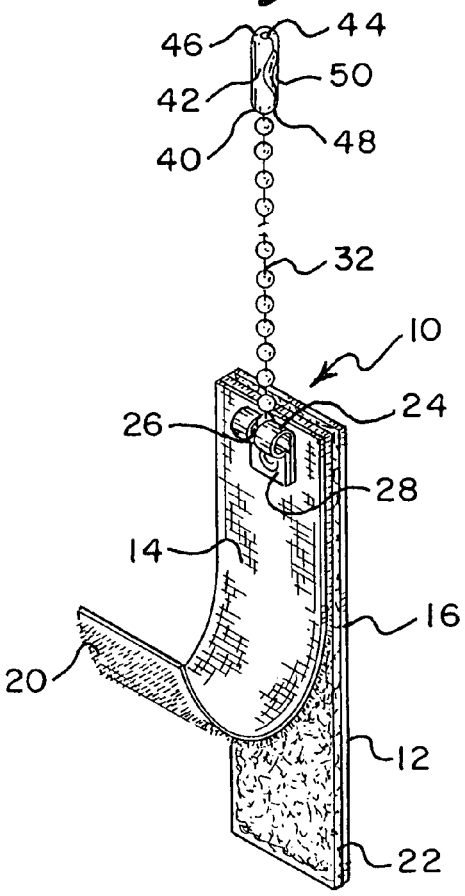
FIG. 2 is a front perspective view of the device of the present invention.

Referring now to the drawings in detail wherein like reference numerals have been used throughout the various figures to designate like elements, there is shown in FIG. 2 a light switch device constructed in accordance with the principles of the present invention and designated generally as 10.

The light switch device for assisting a person lying in a bed to reach a pull chain or cord attached to a light switch located above the bed having at least one movable side rail of the present invention essentially includes an elongated strap 12 having a first or left elongated substantially flat and substantially flat member 14 and a second or right elongated substantially flat and substantially flat member 16, means for releasably securing the left and right members 14 and 16 directly to each other, and means for securing the strap 12 to the pull chain. While the first and second members are also described as left and right members, respectively, it should be realized that the orientation of the members may vary. That is, describing the members as left and right members is by way of example only and corresponds to the orientation of the members as shown in the figures.

Figure 3:
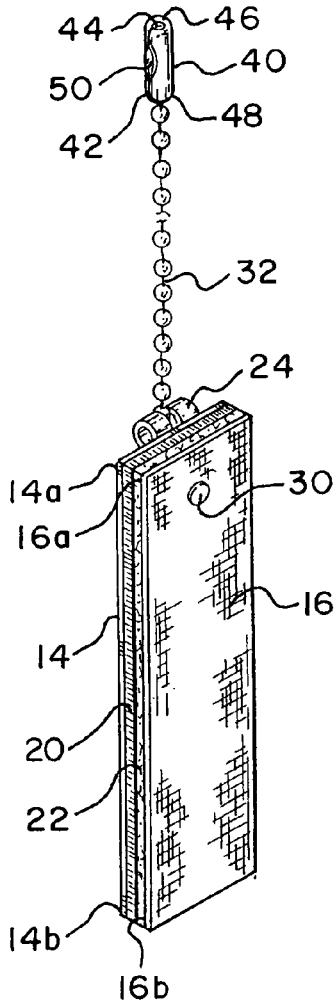
FIG. 3 is a rear perspective view of the device of the present invention.

Each of the members 14 and 16 has a first end 14*a* and 16*a* and a second end 14*b* and 16*b*, respectively, and a substantially flat surface. (See FIG. 3.) The flat surface of the first member is arranged substantially parallel to and opposite the flat surface of the second member. The first ends 14*a* and 16*a* are substantially permanently secured together.

The flat surfaces of the left and right members 14 and 16 of the strap 12 have means for releasably securing the flat surfaces of the first and second members 14 and 16 together and are releasably attachable to the movable side rail 18. The releasable securing means includes hook and loop fasteners 20 and 22 mounted to the left and right members 14 and 16 of the strap 12, respectively. (See FIG. 2.) The left and right members 14 and 16 may be flexible flaps made from fabric, plastic, or other material known and used in the art.

Figure 7:
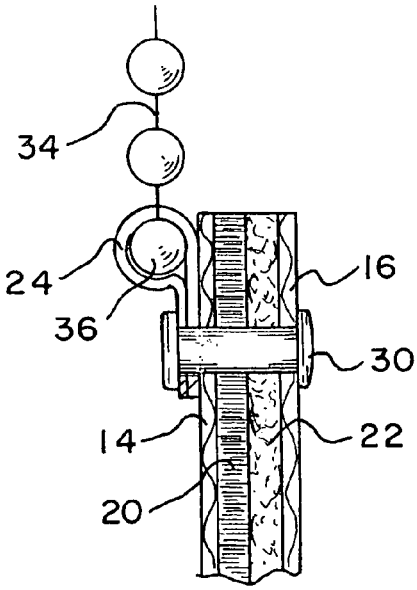
FIG. 7 is a side view of the device of the present invention.

The securing means is located adjacent the first ends 14*a* and 16*a* of the first and second means, respectively, and may include a generally hollow cylindrical member 24 with an opening 26 formed within the length thereof. Extending from the cylindrical member 24 is a flange 28 that is secured via bolt 30, for example, or otherwise fastened to the strap 12. (See FIGS. 3 and 7.) Bolt 30 may also secure the first ends 14*a* and 16*a* of the first and second members 14 and 16, respectively, together. A length of a beaded chain 32 is secured to the strap 12 by inserting a first end 34 of the chain 32 through the opening 26. A bead 36 of the chain 32 is trapped within the opening 26 because the circumference of the bead 36 is smaller than the size of the opening 26. Thus, the chain 32 is secured within the cylindrical member 24. (See FIG. 2.)

A second end 38 of the chain 32 has a lock member 40 secured or attached thereto. The lock member 40 includes an elongated tubular member 42 with an aperture 44 formed in the top 46 and the bottom 48 (bottom aperture not shown). A larger opening 50 is formed along the side of the member 42. (See FIG. 3.) The bead 52 located at the second end 38 of the chain 32 is inserted within the opening 50 and is pulled downwardly so that the portion of the chain connected to the bead 52 extends through the aperture located at the bottom end 48 of the tubular member 42, thereby locking the bead 52 in place at the bottom end 48 of the tubular member 42.

Figure 1:
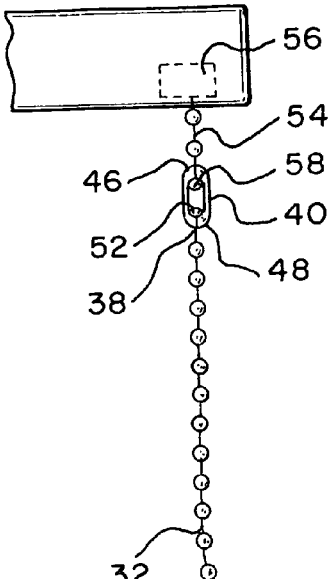
FIG. 1 illustrates the device of the present invention securing a pull chain of a light switch to a movable bed rail.

Similarly, in order to attach the pull chain 54 of the light switch 56 to the strap 12, a bead 58 located at the end of the pull chain 54 of the light switch 56 is placed within the opening 50 and is pulled upwardly so that the portion of the pull chain attached to the bead 58 extends through the aperture 44, thereby locking the bead 58 in place at the top end 46 of the tubular member 42. (See FIGS. 1 and 3.) While the chains have been described as being beaded, it should be realized that any type of chain or cord may be used and the securing means adjusted accordingly.

Figure 4:
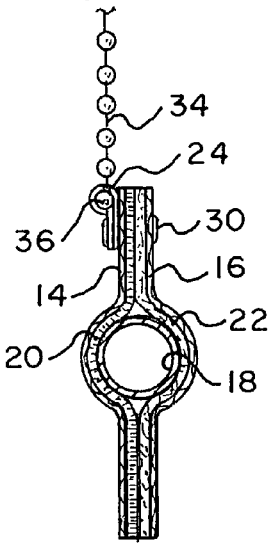
FIG. 4 is a cross-sectional view taken through line 4—4 of FIG. 1.
Figure 4:
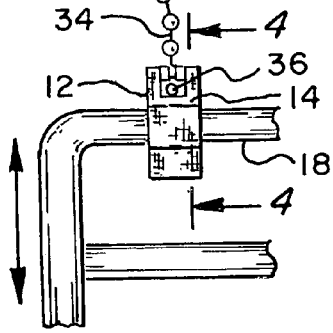

In order to use the device, the pull chain 54 of the light switch 56 is attached to the tubular member 42 as described above. The hook and loop sections 20 and 22 of the left and right members 14 and 16 of the strap 12 are then separated. The side rail 18 of the bed is inserted between the members 14 and 16. The left and right members 14 and 16 are then refastened together about the rail 18. (See FIG. 4.) The light switch is now attached to the rail and can be reached by a person lying in the bed. (See FIG. 1.) In order to release the pull chain 54 of the light switch 56 from the bed, the left right members 14 and 16 of the strap 12 are simply grasped and separated.

Figure 5:
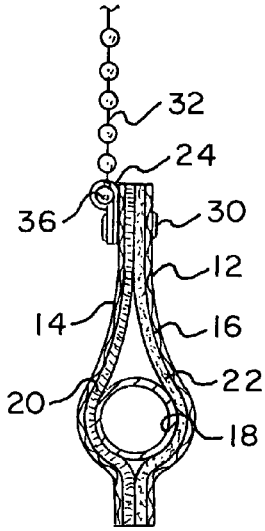
FIGS. 5 and 6 illustrate the steps of the device of the present invention being pulled off of a bed rail.
Figure 6:
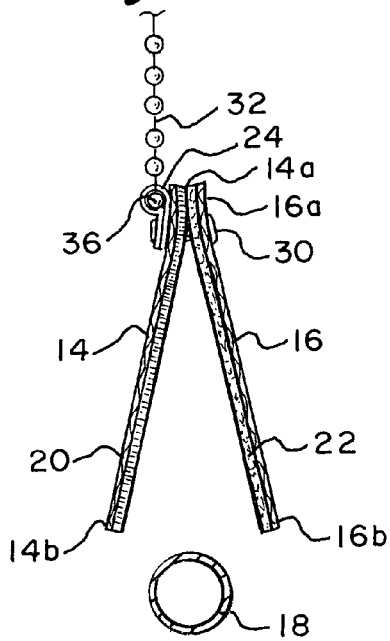

If, however, the pull chain 54 of the light switch 56 inadvertently remains attached to the bed side rail 18 and the rail 18 is lowered or is otherwise moved, pulled, jerked, or yanked the left and right members 14 and 16 of the strap 12 are slowly forced apart. (See FIG. 5.) As the rail 18 continues to be lowered, the hook and loop fasteners 20 and 22 of the left and right members 14 and 16 are completely separated so that the rail 18 is no longer surrounded by the strap 12 and the pull chain 54 of the light switch 56 is released from the rail 18. (See FIG. 6.) Thus, the pull chain remains intact and neither the light switch nor the pull chain is damaged.

The present invention may be embodied in other specific forms without departing from the spirit or essential attributes thereof and accordingly, reference should be made to the appended claims rather than to the foregoing specification as indicating the scope of the invention.

We claim:

1. A switch device that aids a person to reach a pull chain attached to a switch located above a bed having at least one movable side rail comprising:

an elongated strap having first and second elongated substantially flat and substantially flexible members, each of said members having a first end and a second end and a substantially flat surface, the flat surface of said first member being arranged substantially parallel to and opposite the flat surface of said second member;

means for substantially permanently securing said first ends of said first and second members together;

means on said flat surfaces for releasably securing said flat surfaces of said first and second members together; and means adjacent said first ends of said first and second members for securing said strap to the pull chain;

wherein said first and second members of said strap are releasably attached to the movable side rail and said first and second members being capable of being released from the rail when the rail is lowered.

2. The switch device of claim 1 wherein said releasable securing means includes hook and loop fasteners mounted to said first and second members of said strap, respectively.

3. The switch device of claim 1 wherein said securing means of said strap includes a generally hollow cylindrical member with an opening formed along the length thereof, a chain with a first end and a second end, a portion of said end of said chain being insertable through said opening and being secured therein, said second end of the chain having a lock member attached thereto, the pull chain of the switch being secured to said lock member.

4. The switch device of claim 3 wherein said lock member includes an elongated tubular member having a top end and a bottom end with an aperture formed in both said top and bottom ends and an opening formed along the side of said tubular member, said second end of said chain extending through said aperture formed in said bottom end and a portion of the pull chain of the light switch extending through said aperture formed in said top end.

* * * * *